US009068790B2

(12) United States Patent
La Vigne

(10) Patent No.: US 9,068,790 B2
(45) Date of Patent: Jun. 30, 2015

(54) AMBIDEXTROUS SLIDE STOP

(71) Applicant: Art La Vigne, Pinellas Park, FL (US)

(72) Inventor: Art La Vigne, Pinellas Park, FL (US)

( * ) Notice: Subject to any disclaimer, the term of this patent is extended or adjusted under 35 U.S.C. 154(b) by 0 days.

(21) Appl. No.: 14/246,370

(22) Filed: Apr. 7, 2014

(65) Prior Publication Data

US 2014/0338243 A1 Nov. 20, 2014

Related U.S. Application Data

(60) Provisional application No. 61/809,918, filed on Apr. 9, 2013.

(51) Int. Cl.

| | |
|---|---|
| ***F41A 17/42*** | (2006.01) |
| ***F41A 35/06*** | (2006.01) |
| ***F41A 3/68*** | (2006.01) |

(52) U.S. Cl.

CPC . *F41A 35/06* (2013.01); *F41A 3/68* (2013.01); *F41A 17/42* (2013.01)

(58) Field of Classification Search

CPC ..... F41A 17/42; F41A 17/20; F41A 17/22; F41A 17/24; F41A 17/26; F41A 17/28; F41A 17/46; F41A 17/52; F41A 17/62; F41A 17/70; F41A 17/80; F41A 35/06; F41A 3/68

USPC ..... 42/70.01, 70.04, 70.05, 70.08

See application file for complete search history.

(56) References Cited

U.S. PATENT DOCUMENTS

| | | | | |
|---|---|---|---|---|
| 3,492,748 | A | 2/1970 | Swenson | |
| 4,414,769 | A | 11/1983 | Mueschke | |
| 4,742,634 | A | 5/1988 | Swenson | |
| 5,212,327 | A | 5/1993 | Schuemann | |
| 7,047,864 | B2 | 5/2006 | Spinner et al. | |
| 8,276,502 | B1 * | 10/2012 | Wright | 89/148 |
| 8,650,790 | B2 * | 2/2014 | Dionne et al. | 42/70.11 |

FOREIGN PATENT DOCUMENTS

DE 100 08 979 * 9/2001

* cited by examiner

*Primary Examiner* — Stephen M Johnson
(74) *Attorney, Agent, or Firm* — Thomas Frost

(57) ABSTRACT

The present invention is an ambidextrous slide stop for use with a handgun consisting of an assembly of a right side slide stop bracket and a left side slide stop bracket, so that a right handed shooter can still activate on the left side with the right thumb. Alternatively, right side slide stop allows a left handed shooter to use the left thumb to pivot the assembly downward to release the slide. A pivot pin of the right bracket engages with a pivot shaft of the left side bracket.

4 Claims, 13 Drawing Sheets

10
12
50
18
32
40

10
40
42
44
50
12
22

AMBIDEXTROUS SLIDE STOP

The present invention relates to an improved slide stop for semi-automatic handguns, particularly for a Colt Model 1911. This application claims priority from provisional application 61/809,918, filed on Apr. 9, 2013.

FIELD OF INVENTION

Background of Invention

A slide stop on a semi-automatic handgun is a device that catches the slide of the handgun after the magazine's last round has been fired, thereby allowing the user to easily release the slide by pulling down on a switch. It also allows the user to purposefully lock the slide back by pressing up on the switch while racking the slide. Since thumbs are normally used to activate the switch downwardly, the normal slide release is on the left hand side. Handguns are standard for right handed shooters.

In the present invention there is a right side slide stop assembly which allows a left handed shooter to use the left thumb to pivot the assembly downward to release the slide. The full assembly consists of the right side slide stop assembly and left side slide stop, so that a right handed shooter can still activate on the left side with the right thumb. This slide release allows right handed and left handed individuals to use their thumb to pull down and release the slide to move forward and chamber a round or to move the slide to the forward position. It also allows users to employ their non-dominant thumb and forefinger to push down on both sides at the same time. The user has more leverage, and it is easier to release a slide which is held back under strong spring tension.

U.S. Pat. No. 4,414,769 discloses an ambidextrous safety (FIG. 9) having a right side safety with a pivot pin interlock with a left side safety element.

U.S. Pat. No. 4,742,634 illustrates a slide guard (FIG. 5) having a right side slide guard with shaft interlocking with a left side bracket.

U.S. Pat. No. 5,212,327 discloses an ambidextrous thumb safety (FIGS. 7-9) having a right thumb safety with a shaft interlocking with the left hand thumb safety.

SUMMARY OF THE INVENTION

The general purpose of the present invention, which will be described subsequently in greater detail, is to provide new and improved slide stop.

The slide stop has a right side bracket and a left side bracket. The slide stop is mounted in spaced apart relationship with respect to the moveable slide of a handgun.

The right side bracket has a center member comprising a pivot pin and an activation tab. An outer member of the right side bracket has a passage defined to accommodate the pivot pin. A tension spring fits through the passage of the outer member to urge the pivot pin along the passage. The center member and outer member are interconnected.

The left side bracket comprises a side plate having an interlock structure extending from an inner surface of a first end and an activation tab extending outwardly from the outer surface of the side plate. A pivot shaft formed therein extends inwardly from an opposed side of the side plate and fits through a frame of a handgun. The pivot pin of the right bracket engages with the pivot shaft of the left side bracket.

In use, the feeder of in an empty magazine clip of a handgun lifts up the interlock. The activation tabs move downward in the forward position. The interlock is positioned in the slide recess of the handgun. To release the slide of the handgun, either a right handed or left handed shooter can use their thumb to push the activation tabs downward in the rear position.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
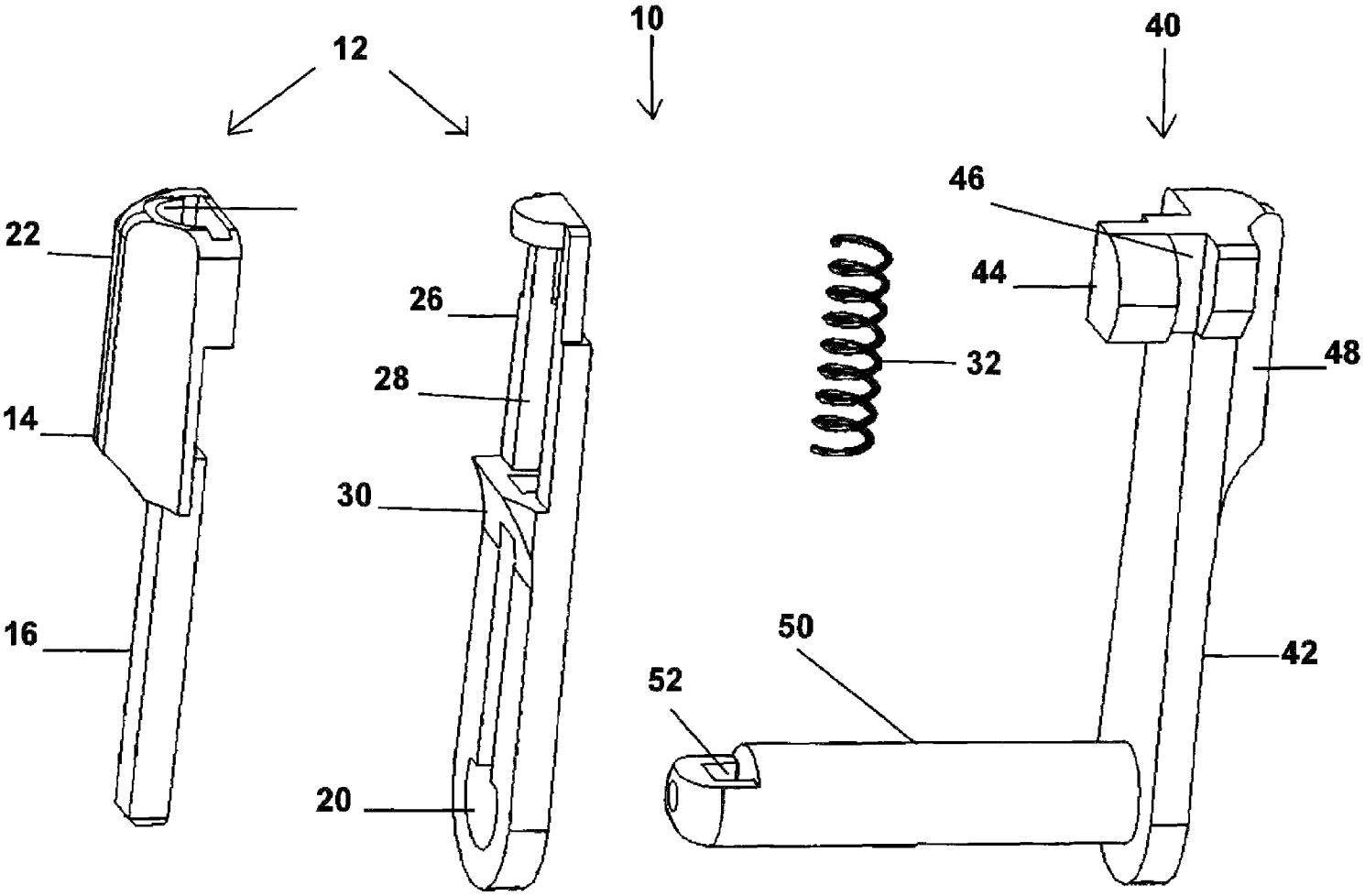
FIG. 1 is an exploded view of a first embodiment of the invention.

Referring to the drawings in general, an embodiment of the present invention 10 will now be described in greater detail.

An embodiment of an ambidextrous slide stop, denoted generally by reference numeral 10, and more fully illustrated in FIG. 1, is shown. The slide stop 10 includes a right side bracket 12 and a left side bracket 40. The slide stop 10 is mounted in spaced apart relationship with respect to the moveable slide of a handgun. The stop 10 is formed of stainless steel.

The right side bracket 12 has an outer member 14 comprising a pivot pin 16, and an activation tab 22. The pin 16 is generally rectangular in shape, and has a first end and a second end. The tab 22 has an outer surface and an inner surface, and a first end and a second end. The outer surface has a sloping surface generally dome-shaped in one section and has a depression formed in a second section. The depression accommodates a user's thumb. The inner surface of the tab 22 has a perimeter planer surface and an upwardly depending annular groove 24 defined therein. The pin 16 is affixed at its first end to the lower surface juxtaposed the first end of the tab 22.

A center member 26 of the right side bracket 12 has an outer peripheral edge and inner walls defining a passage 28 defined therethrough. The passage has a first section of predetermined size to accommodate the pivot pin 16 and a second section defining an opening 20 at a first end of the member 26. A bar 30 is formed traversing the passage along an outer surface of the member 26. A tension spring 32 fits through the passage of the center member 26, and within the groove 24 of the outer member 12. The tension spring 32 pushes the pivot pin 16 along the passage, and abuts the activation tab 22 against the bar 30.

Figures 2A, 2B:
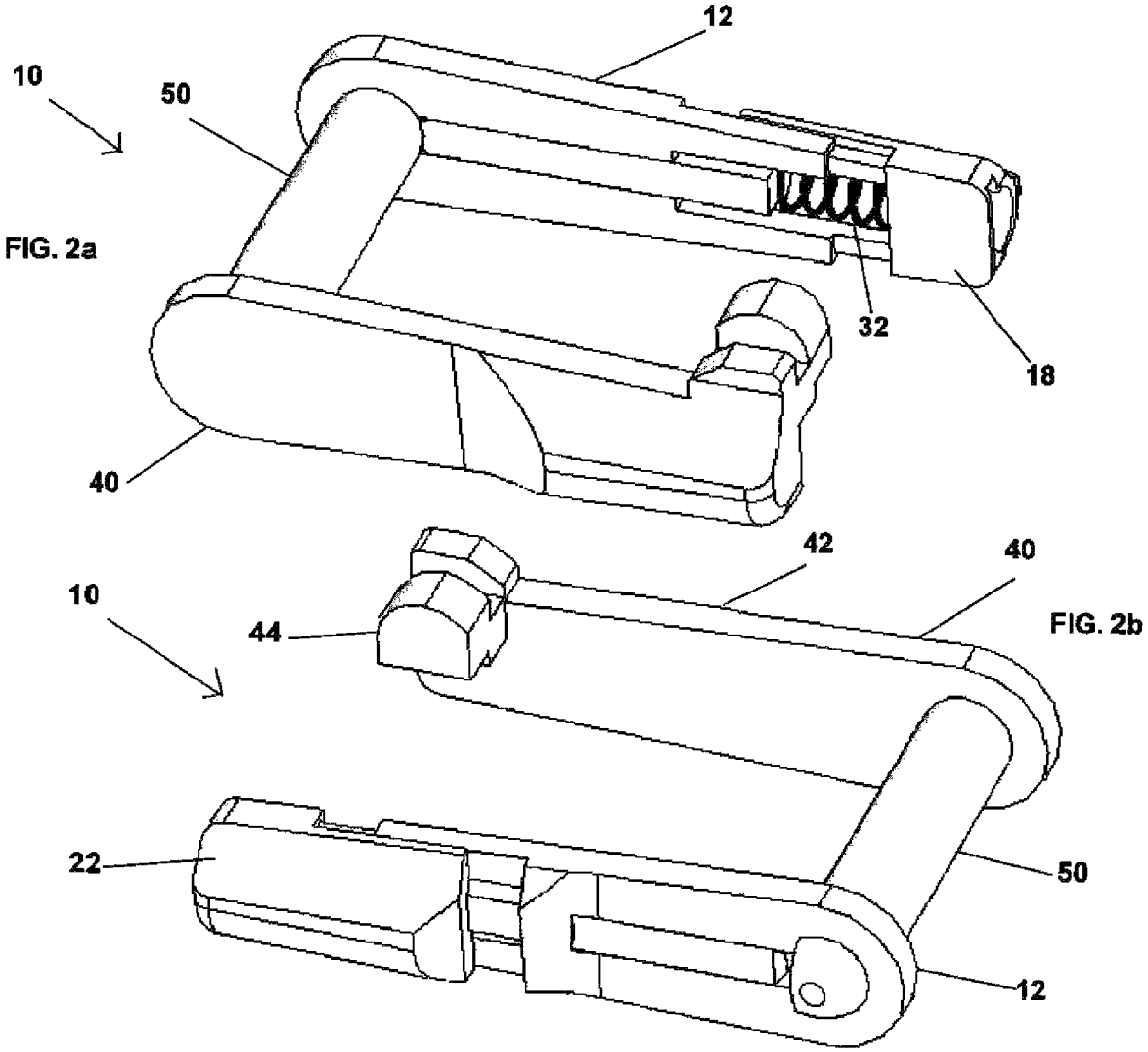
FIG. 2*a* is a left side isometric view of a second embodiment of the invention and FIG. 2*b* is a right side isometric view of the second embodiment.
Figures 3A, 3B, 3C, 3D:
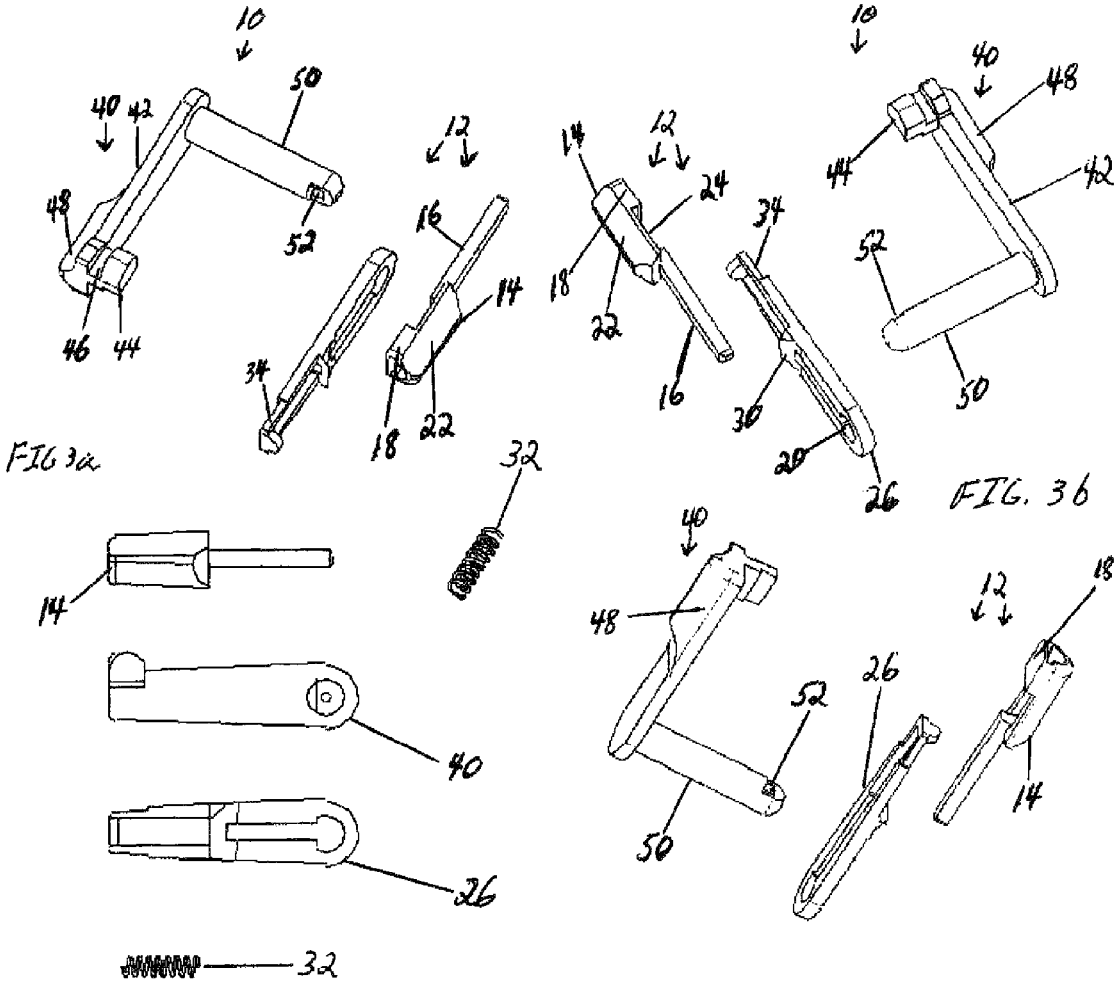
FIGS. 3*a*-3*d* are exploded views of the second embodiment of the invention.
Figure 4A:
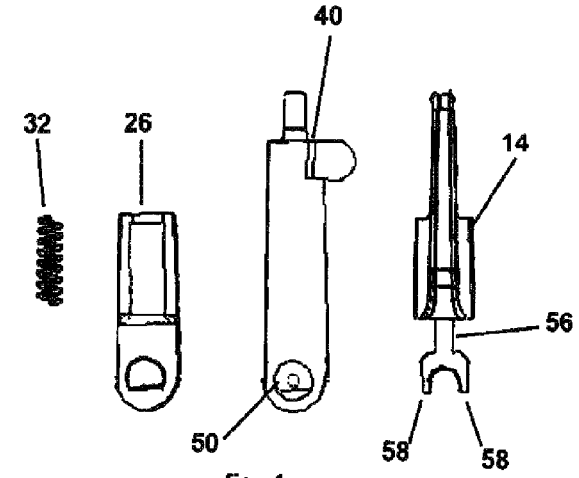
FIGS. 4*a*-4*d* are exploded views of a third embodiment of the invention.
Figure 4B:
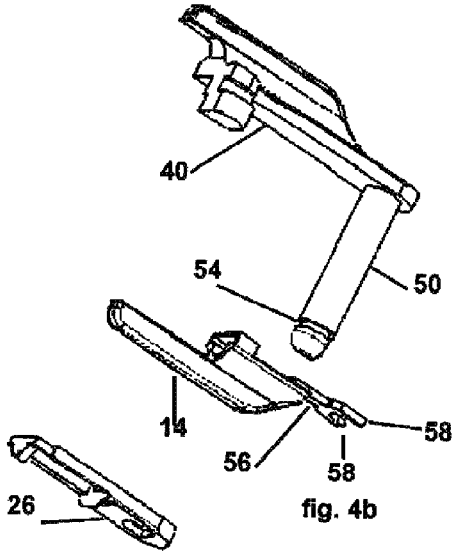
Figure 4C:
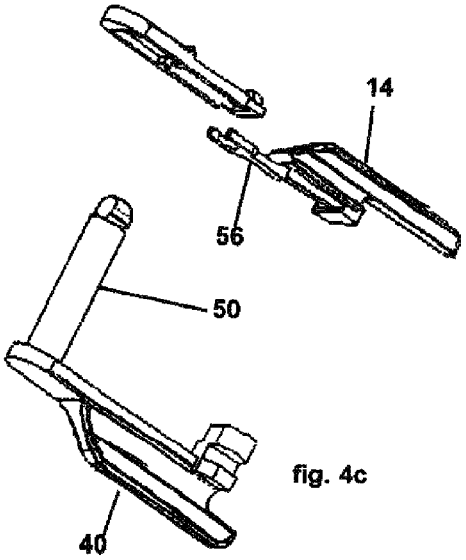
Figure 4D:
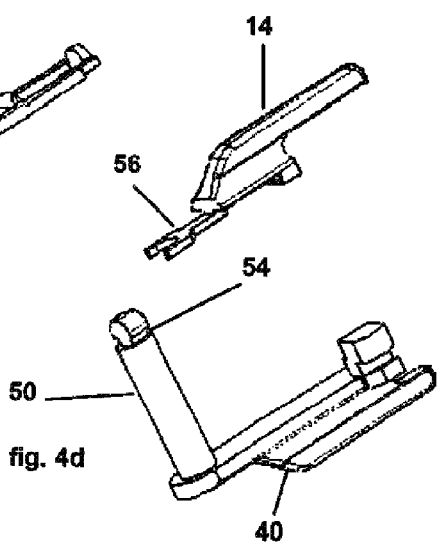
Figure 5:
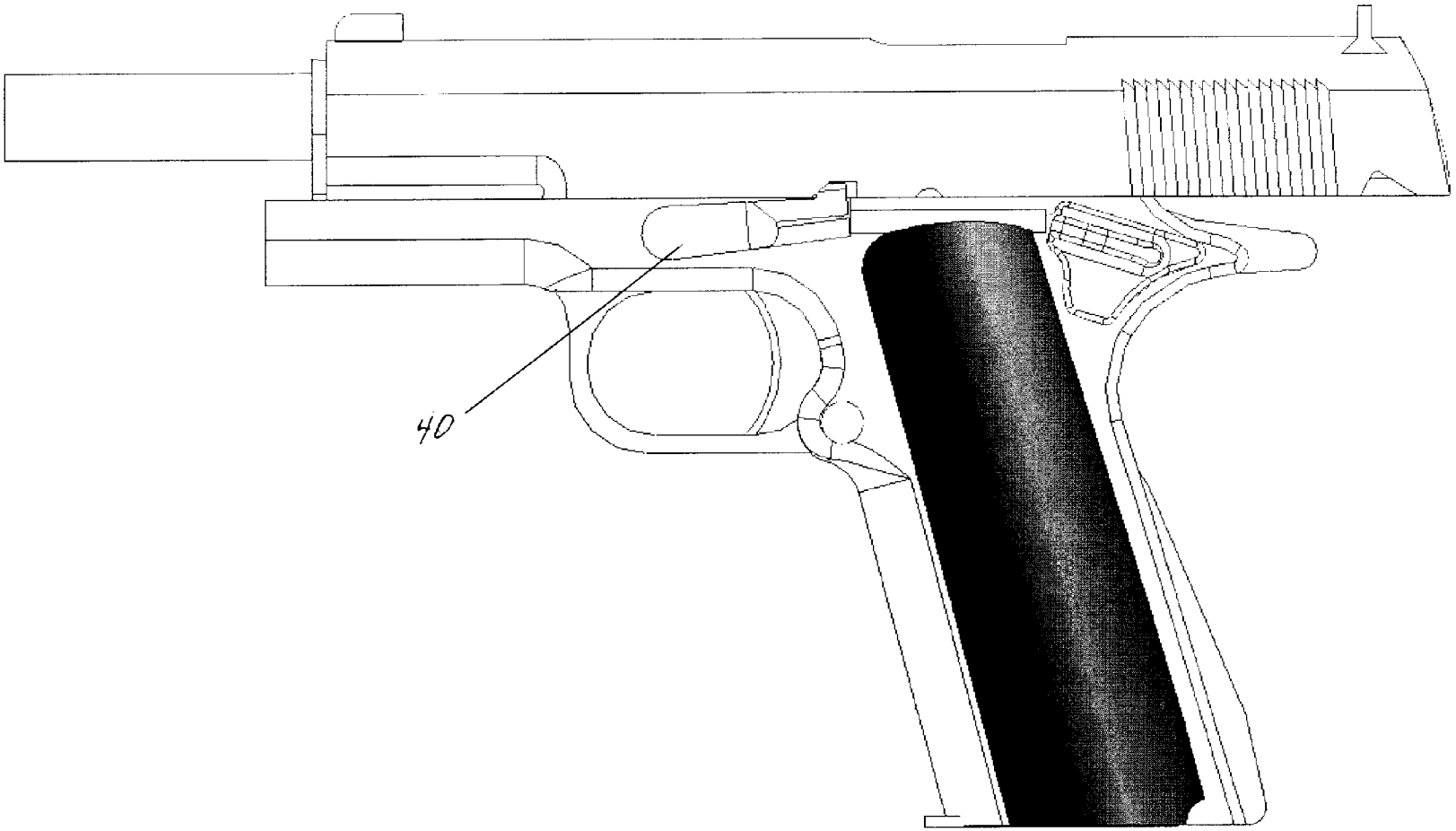
FIG. 5 is a left side elevation view of the slide stop comprising the invention with the slide of the handgun retracted to its rearmost position and the interlock engaged.
Figure 6:
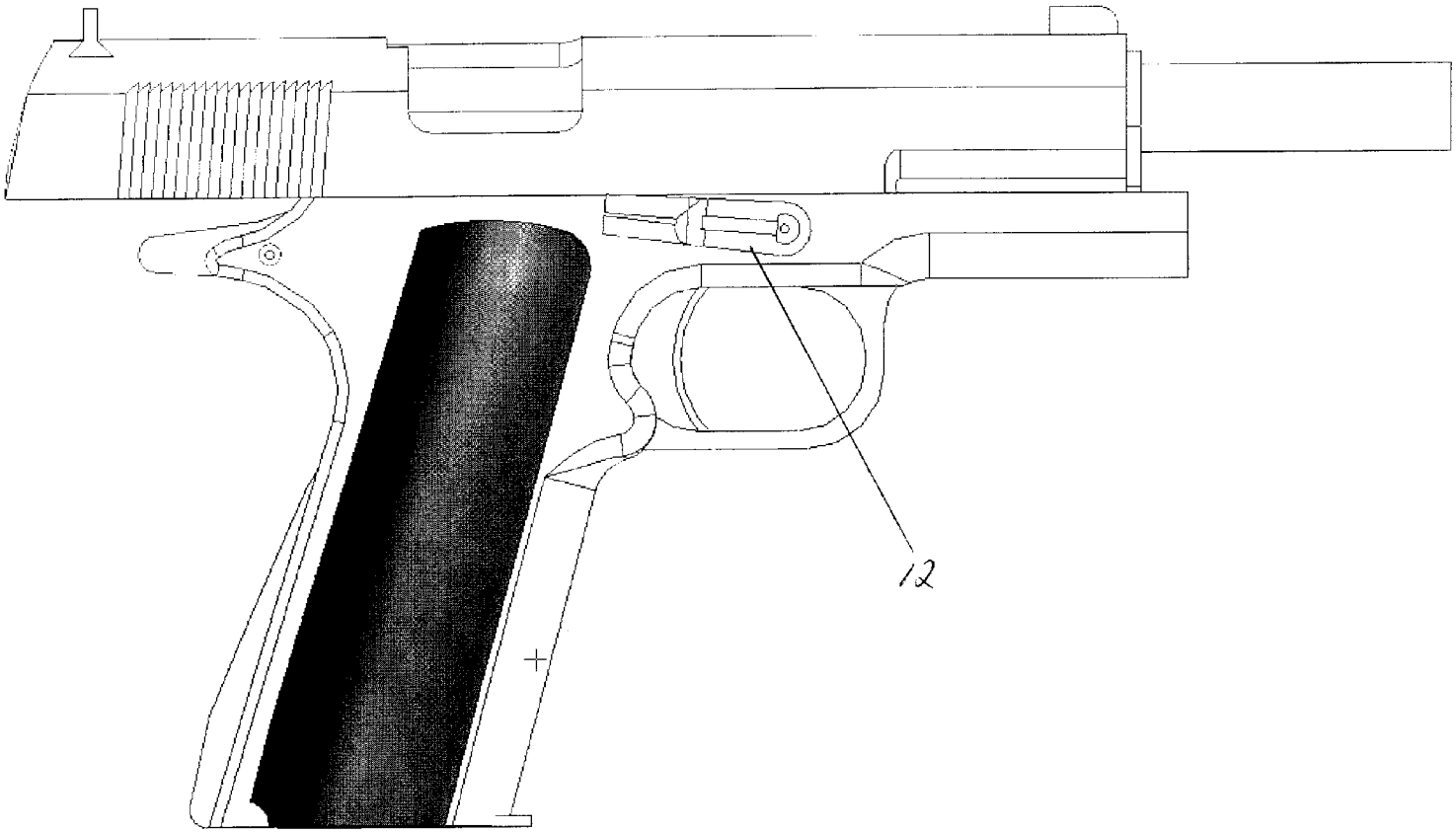
FIG. 6 is a right side elevation view of the slide stop comprising the invention with the slide of the handgun retracted to its rearmost position and the interlock engaged.
Figure 7:
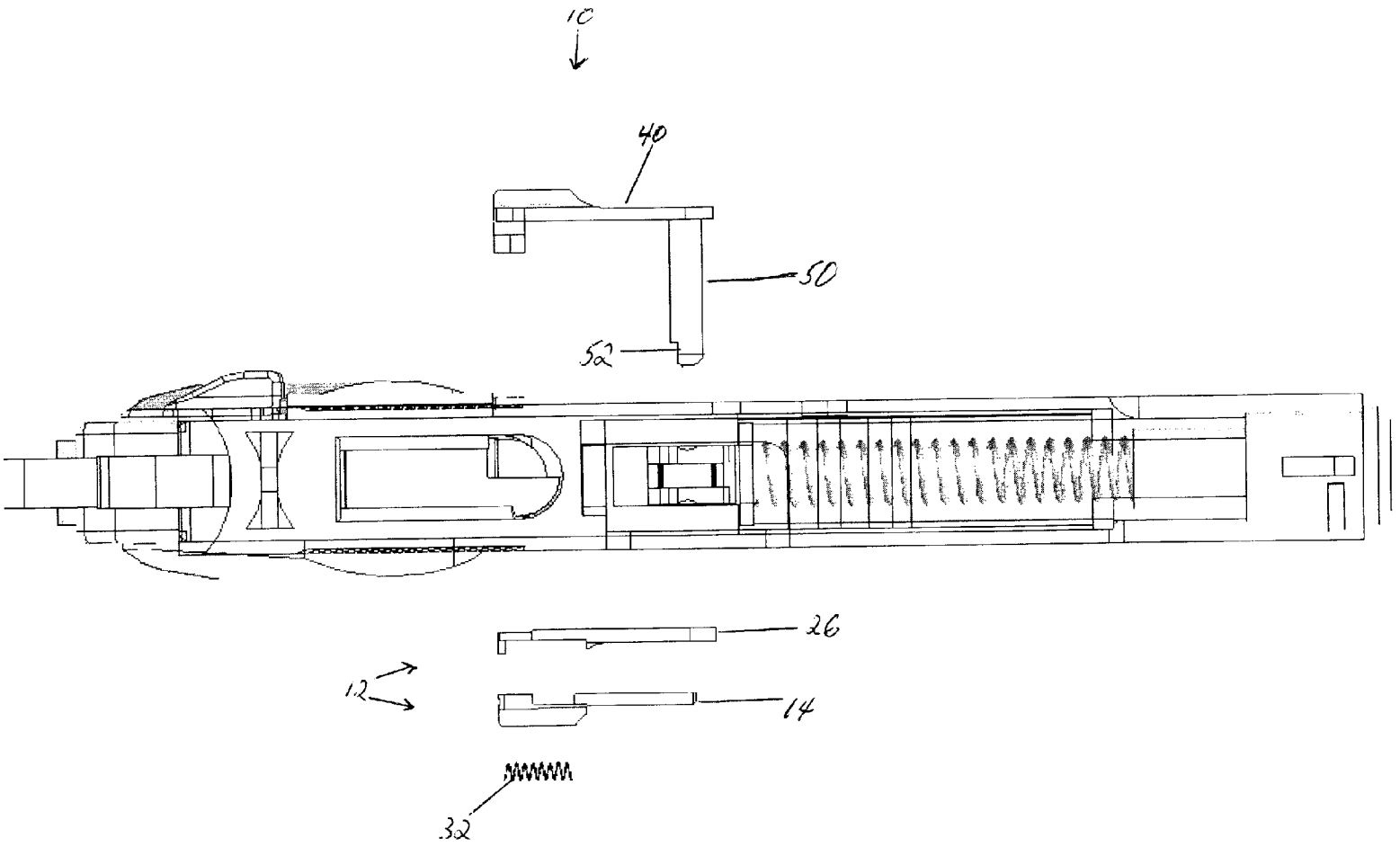
FIG. 7 is a top plan exploded view of the invention with the handgun.

In a second embodiment of the invention 10, as illustrated in FIGS. 2 and 3, a sleeve 18 is integrally formed along the lower surface at the second end of the tab 22. The center member 26 has a notch 34 formed along the outer peripheral edge at a second end of the center member 26. The notch 34 is of a predetermined size and configured to mate with the sleeve 18 of the activation tab 22. Since the tension spring 32 urges the pivot pin 16 in a directional manner, the sleeve 18 facilitates preventing the center member 26 from rotating during use. The members 12, 26 are interconnected.

The left side bracket 40 comprises a side plate structure 42 having a first end and a second end, an interlock 44 structure extending from the inner surface of the first end and activation tab 48 extending outwardly from the outer surface of the side plate 42 opposed the interlock 44. The interlock 44 has a channel 46 integrally formed and defined therein. A pivot shaft 50 with a cavity 52 formed therein extends inwardly from the second end of the side plate 42 and is dimensioned to fit through the frame of a handgun. The cavity 52 positioned is adapted to receive the second end of the pivot pin 16 of the right side bracket 12. The pivot shaft 50 fits through the opening 20 at the distal end of the center member 26 of the right side bracket 12 and the pivot pin 16 engages with the pivot shaft 50. The right side bracket 12 and the left side bracket 40 are now connected to each other on opposed sides of the handgun. The interlock 44 is of a particular configuration required for proper relationship with the slide recess of a semi-automatic handgun. It should be recognized that the activation tabs 22, 48 are not limited to any slope or configuration.

In a third embodiment of the invention 10, as illustrated in FIG. 4, the pivot shaft 50 of the left side bracket 40 has an annular groove 54 defined juxtaposed a second end. The pivot pin of the right side bracket has a C-shaped prong 56 comprised of a pair of arms 58 integrally formed at the second end. The prong 56 is securely engageable with the annular groove 54.

In use, the feeder of in an empty magazine clip of a handgun (not shown) lifts up the interlock 44. The activation tabs move downward in the forward position. As illustrated in FIGS. 3 and 4, the interlock 44 in now positioned in the slide recess of the handgun. To release the slide of the handgun, either a right handed or left handed shooter can use their thumb to push the activation tabs 22, 48 downward in the rear position.

Figure 8:
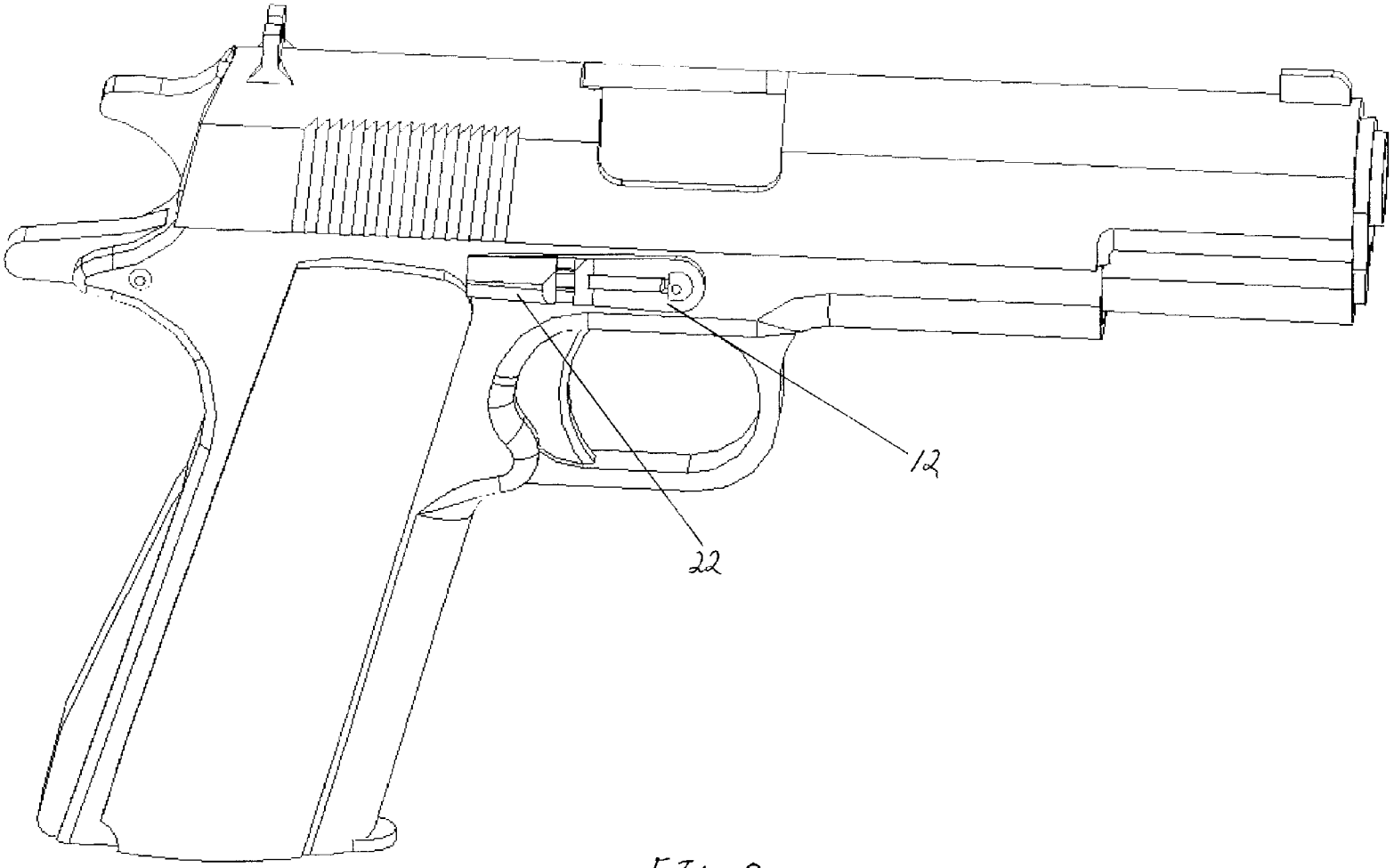
FIG. 8 illustrates a right side view of the handgun with an activation tab of the right side bracket pressed rearward.
Figure 9:
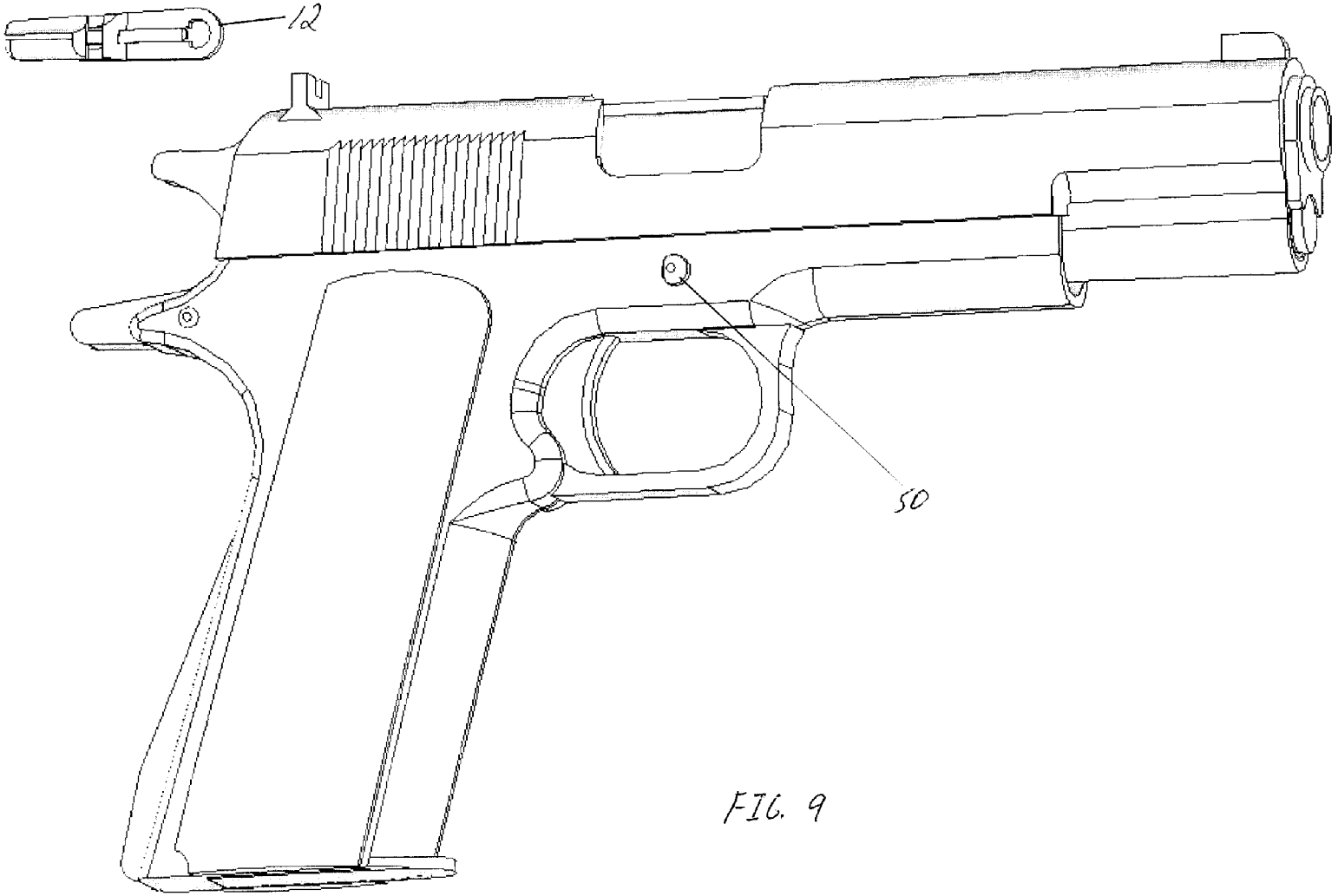
FIG. 9 illustrates the right side bracket removed from the handgun.
Figure 10:
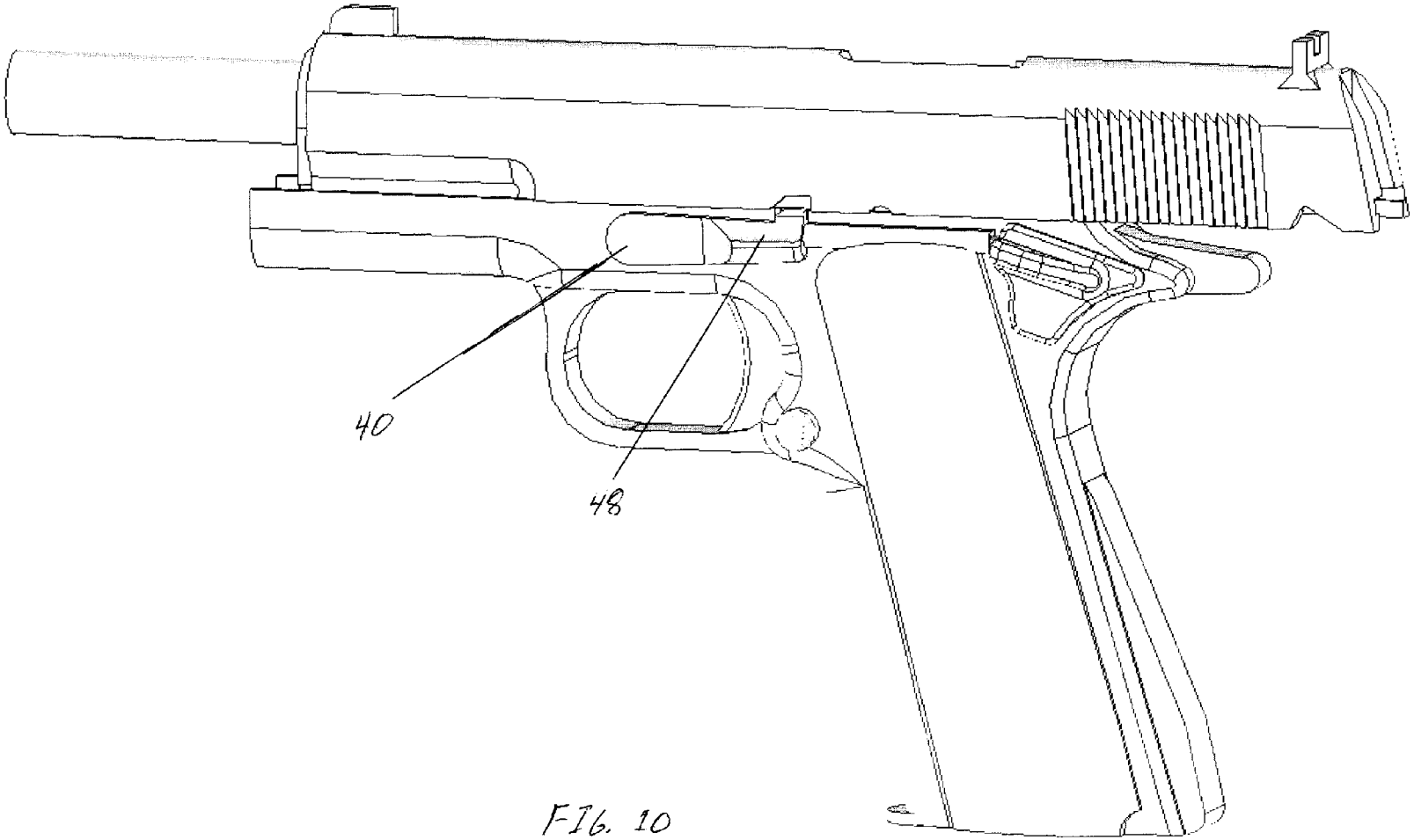
FIG. 10 illustrates the slide of the handgun lined up with a left side bracket.
Figure 11:
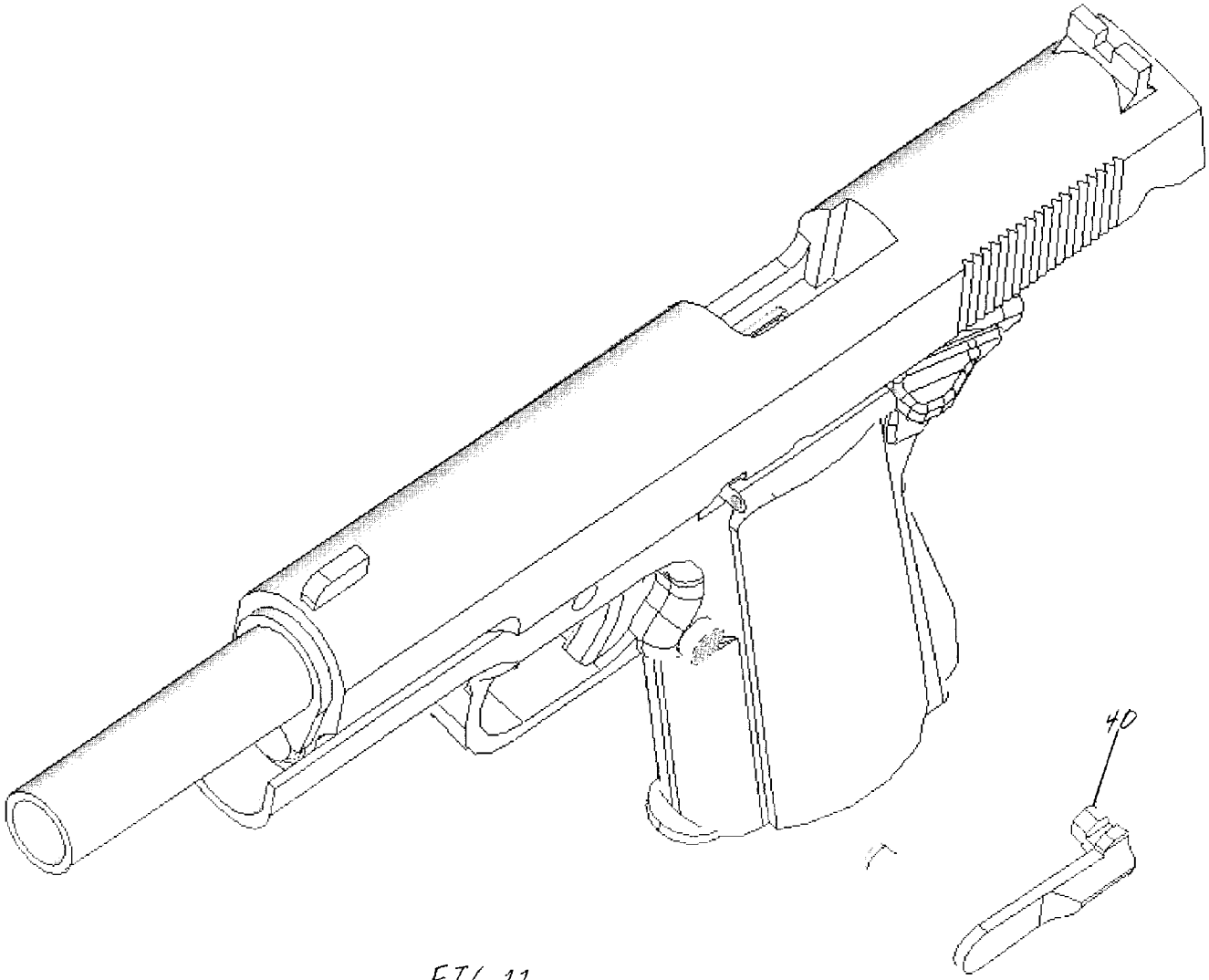
FIG. 11 is a top view of the left side bracket removed from the handgun.
Figure 12:
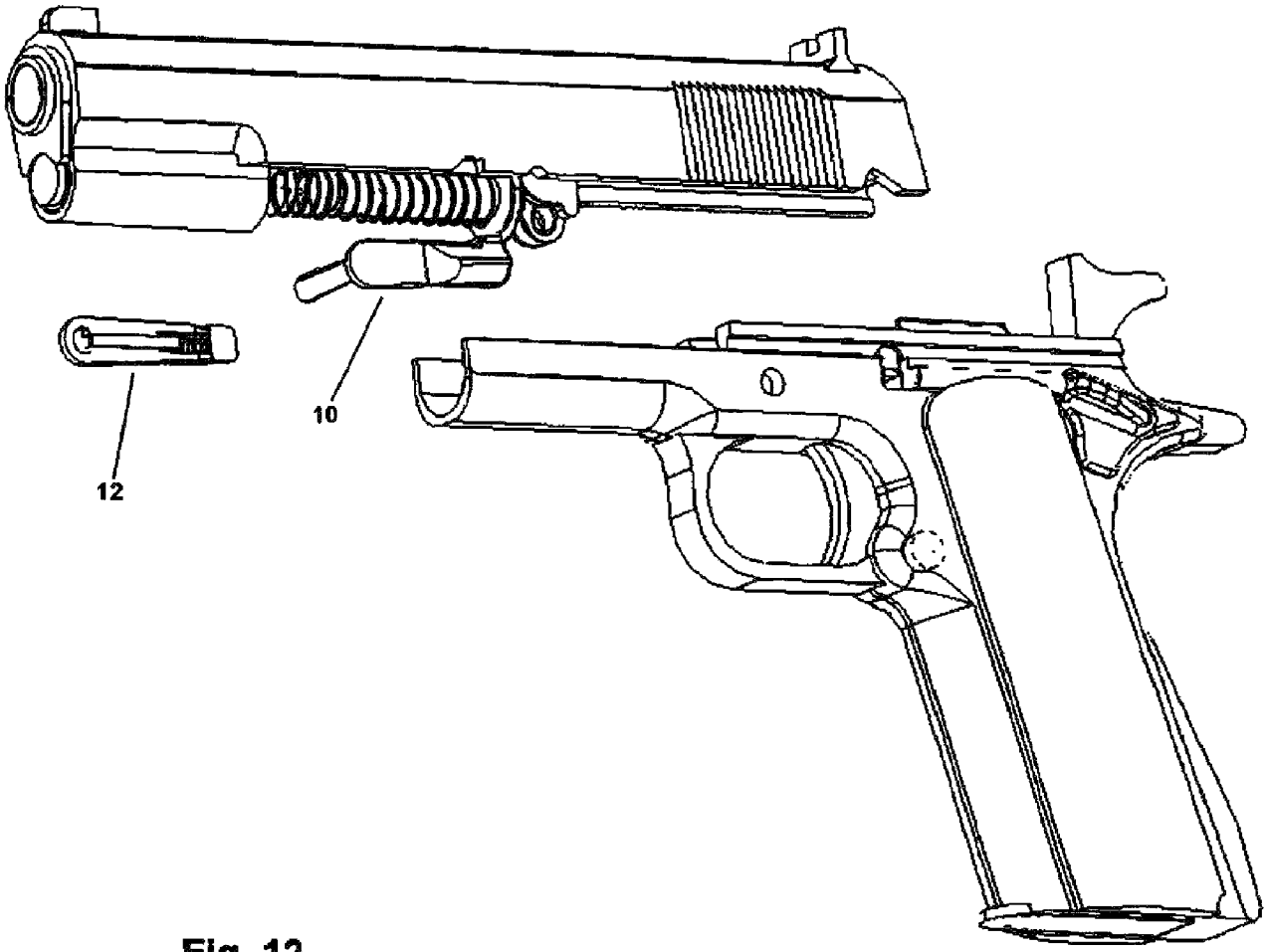
FIG. 12 is an exploded view of the invention with the slide of handgun removed during field stripping.
Figure 13A:
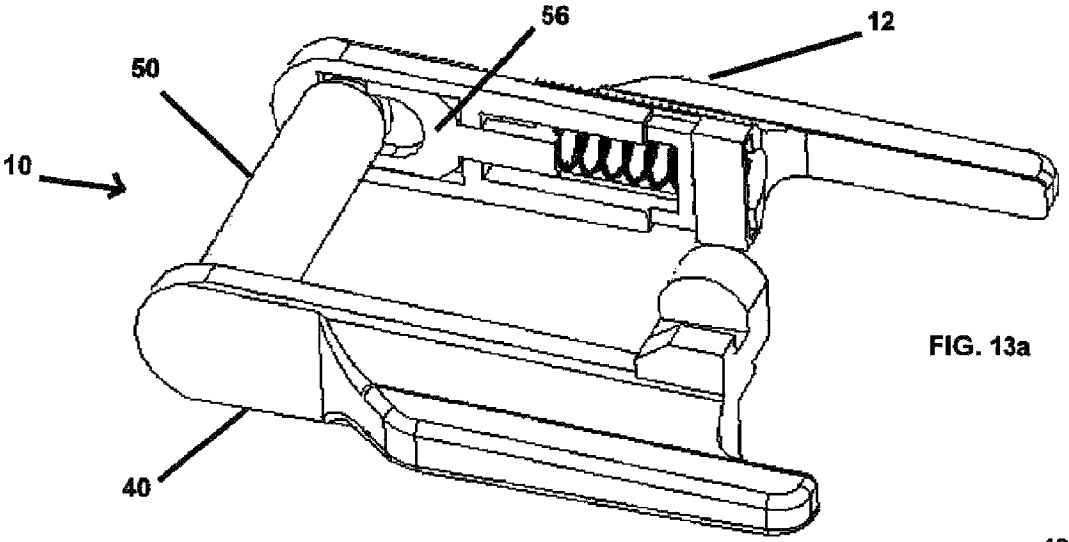
FIG. 13*a* is a left side elevational view of a third embodiment of the invention and FIG. 13*b* is a right side elevational view of the third embodiment.
Figure 13B:
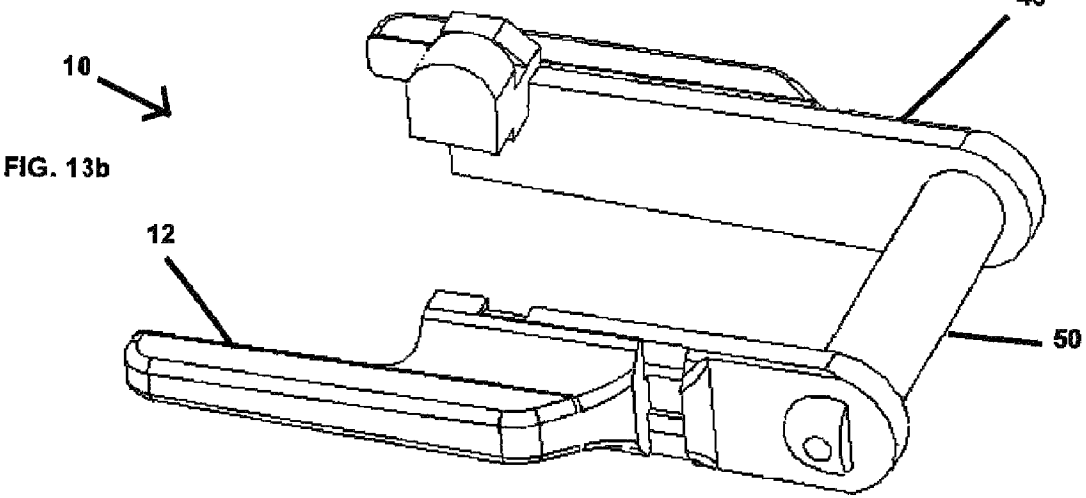

An advantage of the slide stop 10 is the ability to easily field strip the handgun for cleaning, as illustrated in FIGS. 7-11 for a Colt Model 1911. FIG. 8 illustrates a view from a right side of a handgun. The activation tab 22 of the right side bracket 12 is pressed rearward towards the grip of the handgun. The tension spring 32 is compressed and the pivot pin 16 of the right side bracket 12 clears the cavity 52 of the pivot shaft 50 of the left side bracket 40. As shown in FIG. 9, the right side bracket is now disengaged from the left side bracket and removed. Following the standard field stripping process (removing barrel bushing, mainspring housing and recoil spring), the handgun slide is lined up with the left side bracket (FIG. 10). The left side bracket can now also be removed from the frame of the handgun (FIG. 11), and the slide of the handgun removed off the rest of the handgun frame (FIG. 12).

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An ambidextrous slide stop for use with semi-automatic handguns, comprising in combination:

a first assembly mountable to a right side frame of the handgun comprising:

a first member comprised of an activation tab having a first end and a second end, having a groove defined in a lower surface, and further having a pivot pin extending from one end of the tab;

a second member having an outer peripheral edge and inner walls defining a passage therethrough, whereby the passage has a first section of predetermined size to accommodate the pivot pin and a second section defining an opening at a first end of the second member;

a second assembly mountable to a left side frame of the handgun having, a side plate structure with a first end and a second end, an interlock extending from an inner surface of the first end of the side plate structure, an activation tab extending outwardly from an outer surface of the side plate opposed the interlock, and a shaft with a cavity formed therein extending inwardly from the second end of the side plate, structure and mountable through the frame of the handgun;

a tension spring mountable in the groove of the first member; and whereby the shaft fits through the opening of the second member of the first assembly and the pin of the first member of the first assembly engages with the shaft.

2. The stop as set forth in claim 1, whereby the second member of the first assembly further comprises a bar traversing the passage on an upper surface of the second member.

3. The stop as set forth in claim 2, further comprising a sleeve integrally formed along a lower surface of the activation tab of the first assembly, and whereby the second member of the first assembly has a notch formed along its outer peripheral edge mateable with the sleeve.

4. An ambidextrous slide stop for use with semi-automatic handguns, comprising in combination:

a first assembly mountable to a right side frame of the handgun comprising:

a first member comprised of an activation tab having a first end and a second end, having a groove defined in a lower surface, and further having a pivot pin having a first end and a second end, and having a C-shaped prong comprised of a pair of arms integrally formed at the second end of the pin, extending from one end of the tab;

a second member having an outer peripheral edge and inner walls defining a passage therethrough, whereby the passage has a first section of predetermined size to accommodate the pivot pin and a second section defining an opening at a first end of the second member;

a second assembly mountable to a left side frame of the handgun having a side plate structure with a first end and a second end, an interlock extending from an inner surface of the first end of the side plate structure, an activation tab extending outwardly from an outer surface of the side plate opposed the interlock, and a shaft with an annular groove defined juxtaposed a second end, extending inwardly from the second end of the side plate structure and mountable through the frame of the handgun;

a tension spring mountable in the groove of the first member; and whereby the shaft fits through the opening of the second member of the first assembly and the pin of the first member of the first assembly engages with the shaft.

* * * * *